US007397384B1

(12) United States Patent
MacKenzie, IV et al.

(10) Patent No.: US 7,397,384 B1
(45) Date of Patent: Jul. 8, 2008

(54) TRACK LIGHTING SYSTEM CURRENT LIMITING DEVICE

(75) Inventors: Kenneth MacKenzie, IV, Westport Point, MA (US); Alejandro Mier-Langner, Providence, RI (US); Michael S. O'Boyle, S. Dartmouth, MA (US); James Edward Kuchar, Fall River, MA (US)

(73) Assignee: Genlyte Thomas Group, LLC, Louisville, KY (US)

( * ) Notice: Subject to any disclaimer, the term of this patent is extended or adjusted under 35 U.S.C. 154(b) by 34 days.

(21) Appl. No.: 11/056,309

(22) Filed: Feb. 11, 2005

(51) Int. Cl.
*G08B 21/00* (2006.01)

(52) U.S. Cl. ..... 340/638; 340/635; 340/664; 361/673; 307/125

(58) Field of Classification Search ..... 340/638, 340/635, 636.12, 636.17, 639, 664; 324/509; 361/643, 673; 315/209 R; 307/125
See application file for complete search history.

(56) References Cited

U.S. PATENT DOCUMENTS

| | | | |
|---|---|---|---|
| 1,301,994 | A | 4/1919 | Archer |
| 1,879,600 | A | 9/1932 | Burchett |
| 1,885,513 | A | 11/1932 | Mask |
| 1,977,883 | A | 10/1934 | Levy |
| 2,026,884 | A | 1/1936 | Glasgow |
| 2,108,052 | A | 2/1938 | Eitzen |
| 2,614,457 | A | 10/1952 | Weber |
| 2,856,592 | A | 10/1958 | Carlson |
| 2,946,037 | A | 7/1960 | Platz et al. |
| 3,120,985 | A | 2/1964 | Hubbell |
| 3,180,981 | A | 4/1965 | Ulffers |
| 3,273,103 | A | 9/1966 | Ericson |
| 3,298,277 | A | 1/1967 | Scharf |
| 3,391,377 | A | 7/1968 | Corl et al. |
| 3,529,275 | A | 9/1970 | Routh |
| 3,559,146 | A | 1/1971 | Valtonen |
| 3,562,616 | A | 2/1971 | Elliott |
| 3,622,938 | A | 11/1971 | Masamichi et al. |
| 3,646,501 | A | 2/1972 | Valtonen |
| 3,686,614 | A | 8/1972 | Hyrylainen |
| 3,718,886 | A | 2/1973 | Hoffmeister |
| 3,737,761 | A | 6/1973 | Walther |
| 3,757,273 | A | 9/1973 | Hesse |
| 3,760,133 | A | 9/1973 | Howard |
| 3,832,503 | A | 8/1974 | Crane |
| 3,848,715 | A | 11/1974 | Hesse |
| 3,884,541 | A | 5/1975 | O'Nan et al. |
| 3,894,781 | A | 7/1975 | Donato |
| 3,896,355 | A | 7/1975 | Guicheteau |
| 3,933,403 | A | 1/1976 | Rubesamen et al. |
| 3,940,634 | A | 2/1976 | Grogan |
| 3,959,644 | A | 5/1976 | Dammel et al. |

(Continued)

*Primary Examiner*—George A Bugg
*Assistant Examiner*—Eric M. Blount
(74) *Attorney, Agent, or Firm*—Alexander P. Brackett; Middleton Reutlinger

(57) ABSTRACT

A current limiting system in accordance with the present invention comprises an accessory or canopy mount device that is permanently installed between a source of electrical power 1 and a track lighting system 2. The system may be installed integrally with a track lighting system to supply power to a plurality of lighting tracks from a plurality of power sources or circuits, as desired by a user or lighting designer. The system may also be configured to be compatible with a wide variety of track lighting system power tracks and is difficult to remove once properly installed, thereby making it tamper-proof.

34 Claims, 5 Drawing Sheets

U.S. PATENT DOCUMENTS 3,971,967 A 7/1976 Hawkins
3,980,368 A 9/1976 Fremont
3,993,385 A 11/1976 Seger
4,001,571 A 1/1977 Martin
4,007,378 A 2/1977 Lazzara
4,029,378 A 6/1977 Bolis
4,032,208 A 6/1977 Berkenhoff
4,052,625 A 10/1977 Cameron
4,053,194 A 10/1977 Gilman
4,085,988 A 4/1978 Gamble
4,108,523 A 8/1978 Bolis
4,118,658 A 10/1978 Salva et al.
4,139,252 A 2/1979 Gorny
4,181,388 A 1/1980 Donato
4,200,862 A 4/1980 Campbell et al.
4,211,460 A 7/1980 Seelbach et al.
4,218,108 A 8/1980 El Mouchi
4,250,437 A 2/1981 Morton et al.
4,289,365 A 9/1981 Rutgers
4,298,869 A 11/1981 Okuno
4,319,114 A 3/1982 Bell, Jr. et al.
4,352,993 A 10/1982 Hannas
4,375,106 A 2/1983 Voll
4,392,187 A 7/1983 Bornhorst
4,508,400 A 4/1985 Herbert
4,533,190 A 8/1985 Booty
4,557,547 A 12/1985 Stuart
4,584,506 A 4/1986 Kaszmann
4,598,345 A 7/1986 Kleeman
4,626,747 A 12/1986 Nilssen
4,651,059 A 3/1987 Nilssen
4,655,520 A 4/1987 Cummings
4,667,133 A * 5/1987 Nilssen ..... 315/312
4,670,699 A 6/1987 Yang
4,676,567 A 6/1987 Mouchi
4,684,822 A 8/1987 Angott
4,688,154 A * 8/1987 Nilssen ..... 362/147
4,699,439 A 10/1987 Cohen
4,701,833 A 10/1987 Bornhorst
4,712,167 A 12/1987 Gordin et al.
4,722,030 A 1/1988 Bowden
4,748,532 A 5/1988 Commander et al.
4,779,168 A 10/1988 Montgomery
4,790,766 A 12/1988 Booty, Sr. et al.
4,797,795 A 1/1989 Callahan
4,822,292 A 4/1989 Thayer et al.
4,861,273 A 8/1989 Wenman et al.
4,887,196 A 12/1989 Brown et al.
4,947,302 A 8/1990 Callahan
4,968,262 A 11/1990 Widell et al.
4,992,709 A 2/1991 Griffin
5,013,251 A 5/1991 Stringer et al.
5,031,082 A 7/1991 Bierend
5,038,261 A 8/1991 Kloos
5,047,696 A 9/1991 Nilssen
5,055,746 A 10/1991 Hu et al.
5,072,216 A 12/1991 Grange
5,151,038 A 9/1992 Range et al.
5,176,442 A 1/1993 Richardson
5,180,952 A * 1/1993 Nilssen ..... 315/210
5,191,501 A 3/1993 Blau
5,192,126 A 3/1993 Remeyer et al.
5,209,560 A 5/1993 Taylor et al.
5,329,431 A 7/1994 Taylor et al.
5,336,097 A 8/1994 Williamson, Jr. et al.
5,347,431 A 9/1994 Blackwell et al.
5,382,947 A 1/1995 Thaler et al.
5,406,176 A 4/1995 Sugden
5,502,627 A 3/1996 Hunt et al.
5,506,715 A 4/1996 Zhu
5,526,245 A 6/1996 Davis et al.
5,554,979 A 9/1996 Kohar et al.
5,563,472 A 10/1996 Cassidy
5,593,224 A 1/1997 Kunkel et al.
5,637,964 A 6/1997 Hakkarainen et al.
5,640,069 A * 6/1997 Nilssen ..... 315/209 R
5,691,603 A * 11/1997 Nilssen ..... 315/209 R
5,731,667 A 3/1998 Luchetta et al.
5,769,531 A 6/1998 Hunt et al.
5,803,755 A 9/1998 Kuchar et al.
5,855,485 A 1/1999 Patti
5,921,659 A 7/1999 Hunt et al.
5,938,362 A 8/1999 Bastiansen
5,988,838 A 11/1999 Rudenberg
5,989,067 A 11/1999 Morgan et al.
6,004,005 A 12/1999 Demshki, Jr.
6,032,432 A 3/2000 Patti
6,079,992 A 6/2000 Kuchar et al.
6,120,262 A 9/2000 McDonough et al.
6,127,925 A 10/2000 Bonsignore et al.
6,130,412 A 10/2000 Sizemore
6,163,275 A 12/2000 Hartzell
6,169,377 B1 1/2001 Bryde et al.
6,174,073 B1 1/2001 Regan et al.
6,192,282 B1 2/2001 Smith et al.
6,220,721 B1 4/2001 Chan et al.
6,246,182 B1 6/2001 Yamasaki et al.
6,273,587 B1 8/2001 Demshki
6,300,725 B1 * 10/2001 Zinkler et al. ..... 315/291
6,515,437 B1 * 2/2003 Zinkler et al. ..... 315/312
6,567,032 B1 5/2003 Mullaly et al.
6,597,129 B2 7/2003 Newman
RE38,259 E 10/2003 Kuchar et al.
6,655,817 B2 12/2003 Devlin et al.
6,687,487 B1 2/2004 Mosebrook et al.
6,700,333 B1 * 3/2004 Hirshi et al. ..... 315/291
6,774,307 B2 * 8/2004 Kruse et al. ..... 174/53
6,897,747 B2 * 5/2005 Brandon et al. ..... 335/17
7,018,072 B2 3/2006 Mier-Langner et al.
7,024,119 B1 4/2006 Mier-Langner et al.
7,027,736 B1 4/2006 Mier-Langner et al.
7,095,302 B2 * 8/2006 Puskar et al. ..... 335/17
7,111,957 B2 9/2006 Bernhart et al.
7,119,548 B1 * 10/2006 Cook et al. ..... 324/547
7,175,300 B1 2/2007 Medeiros
2001/0040805 A1 11/2001 Lansing et al.
2006/0039168 A1 2/2006 Mier-Langner et al.

* cited by examiner

TRACK LIGHTING SYSTEM CURRENT LIMITING DEVICE

BACKGROUND OF THE INVENTION

Field of the Invention

The present invention relates generally to a current limiting device and more specifically to a modular, tamper-proof current limiting device for use in track lighting systems.

BRIEF DESCRIPTION OF THE DRAWING FIGURES

DETAILED DESCRIPTION OF THE PREFERRED EMBODIMENT(S)

Figure 1:
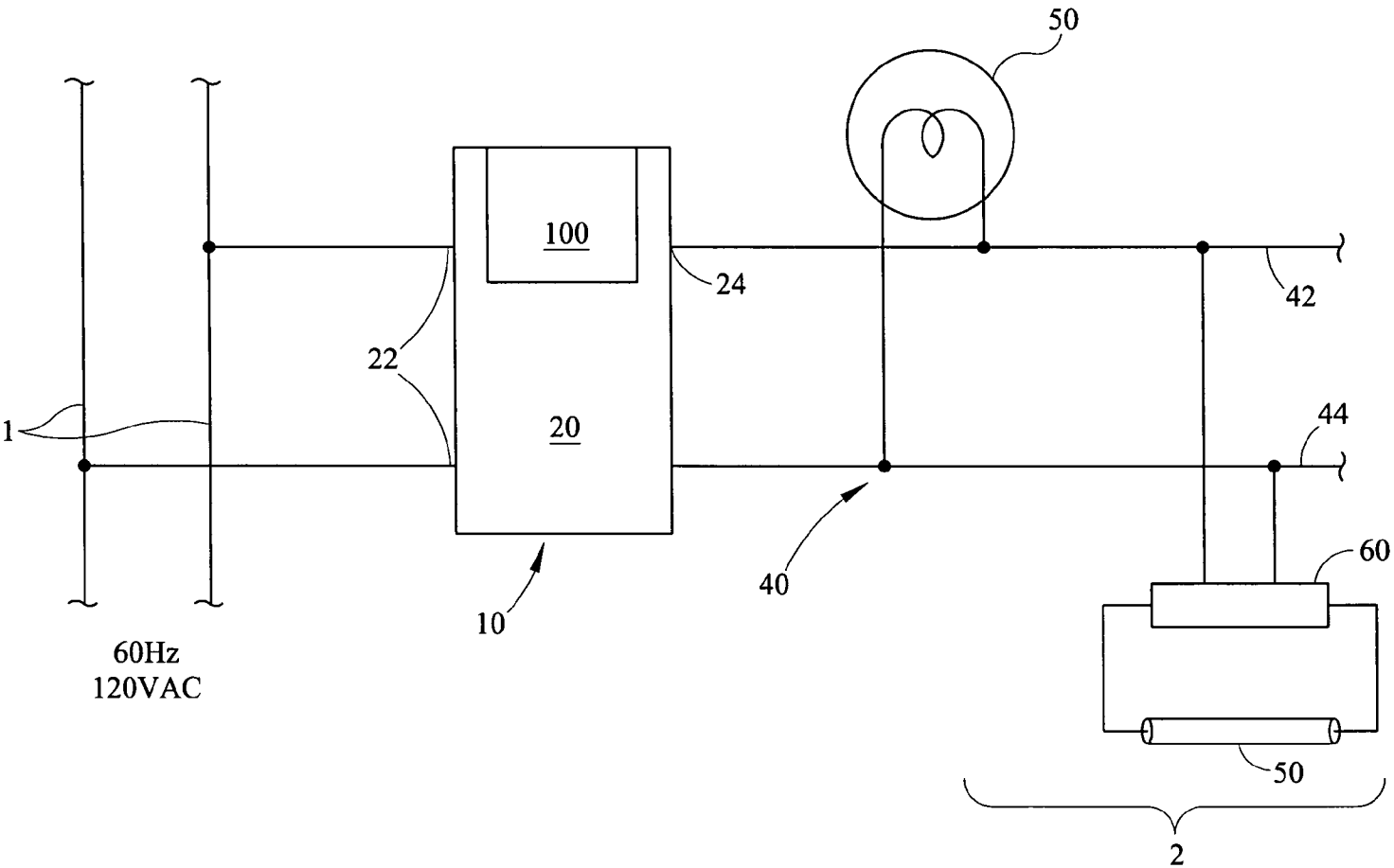
FIG. 1 is schematic diagram in accordance with one embodiment of the present invention.

Referring now to the drawing Figures, and in accordance with a preferred constructed embodiment of the present invention, the system of the present invention provides a current limiting device for use integrally with, for example, a track lighting system. The instant invention will permit a user or installer to limit the electrical current that it is possible to supply to a section of lighting track, thereby permitting its use under local electrical or energy conservation code provisions that require lighting track to be limited to a predetermined wattage per linear foot, whether that track is being utilized to supply power to a lamp or not.

The current limiting system of the present invention is an accessory or canopy mount device that is permanently installed between a source of electrical power 1 and a track lighting system 2. Furthermore, the system may be installed integrally with a track lighting system to supply power to a plurality of lighting tracks from a plurality of power sources or circuits, as desired by a user or lighting designer. The system may also be configured to be compatible with a wide variety of track lighting system power tracks and is difficult to remove once properly installed, thereby making it tamper-proof.

The present invention may include as a current limiting device a conventional circuit breaker, fuse, current limiting relay, or thermistor, or alternatively a plurality thereof that are installed in apertures in a mounting canopy. This feature of the present invention permits an installer or designer to size the breaker for the amount of track to be powered by the system in order to comply with any applicable code.

As seen in FIGS. 1-5, the system 10 of the present invention comprises at least one current limiting device 20 that includes an input 22 for accepting electrical power from a power source 1, and an output 24 for supplying the electrical power to a track lighting system 40 that may have a plurality of lamps 50 connected thereto. The track lighting system 40 includes a pair of electrical conductors 42 and 44 that carry electrical power to the lamps 50 secured to track rail 46, as is known in the art. Furthermore, the system 10 may include a conventional ballast 60, or a plurality thereof for starting fluorescent or high intensity discharge lamps. While the present specification will refer to a system 10 that operates using 120VAC single phase electrical power, one of ordinary skill in the art will appreciate that the present system may be employed with a wide variety of power distribution systems and circuits, including multi-phase power circuits and DC power circuits.

The current limiting device 20 may comprise a circuit breaker 30 having a reset switch 32 for connecting and disconnecting the power source 1 from the track lighting system 40 as well as resetting the breaker 30 when tripped. The circuit breaker 30 may be selected to trip at a predetermined current level as necessary to protect a predetermined length of track rail 46, or comply with applicable codes. For example, the circuit breaker may be sized to trip when a current level within a predetermined percentage over a maximum limit is reached based on the linear feet of track rail 46 used in a given installation. While the present specification discusses primarily conventional circuit breakers 30 for use as current limiting devices 20, alternatively, a wide variety of current limiting devices 20 may be employed in the present invention, including, but not limited to fuses, current limiting relays, thermistors, solid state CLD's, current limiting diodes, and MOSFET switches.

Figure 3:
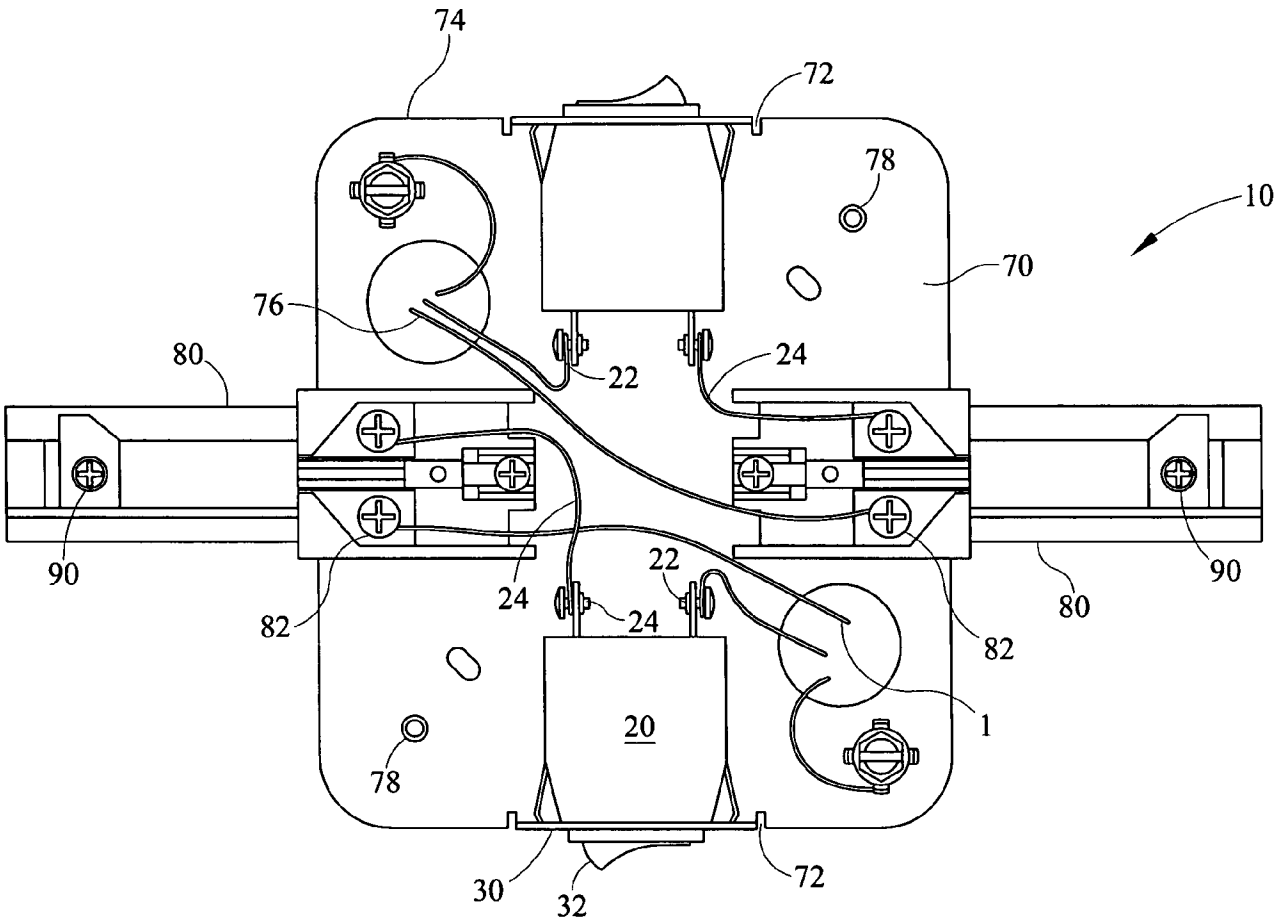
FIG. 3 is a plan view of the system of the present invention in accordance with one embodiment thereof.

The present invention further comprises a canopy 70 having at least one aperture 72 located in a side portion 74 thereof, into which a circuit breaker 30 may be secured such that the switch 32 of the circuit breaker may be readily accessed from the exterior of the canopy 70. A plurality of apertures 72 may be included at various locations around the canopy 70 to accommodate a plurality of circuit breakers 30. This feature of the present invention is particularly advantageous when it is necessary to supply a plurality of track lighting systems 40 from a single location, but with different power circuits. For example, FIG. 3 depicts a system 10 in accordance with the present invention that employs two circuit breakers 30 mounted in the canopy 70 for supplying two separate track lighting systems 40 from two separate power circuits.

Figure 2:
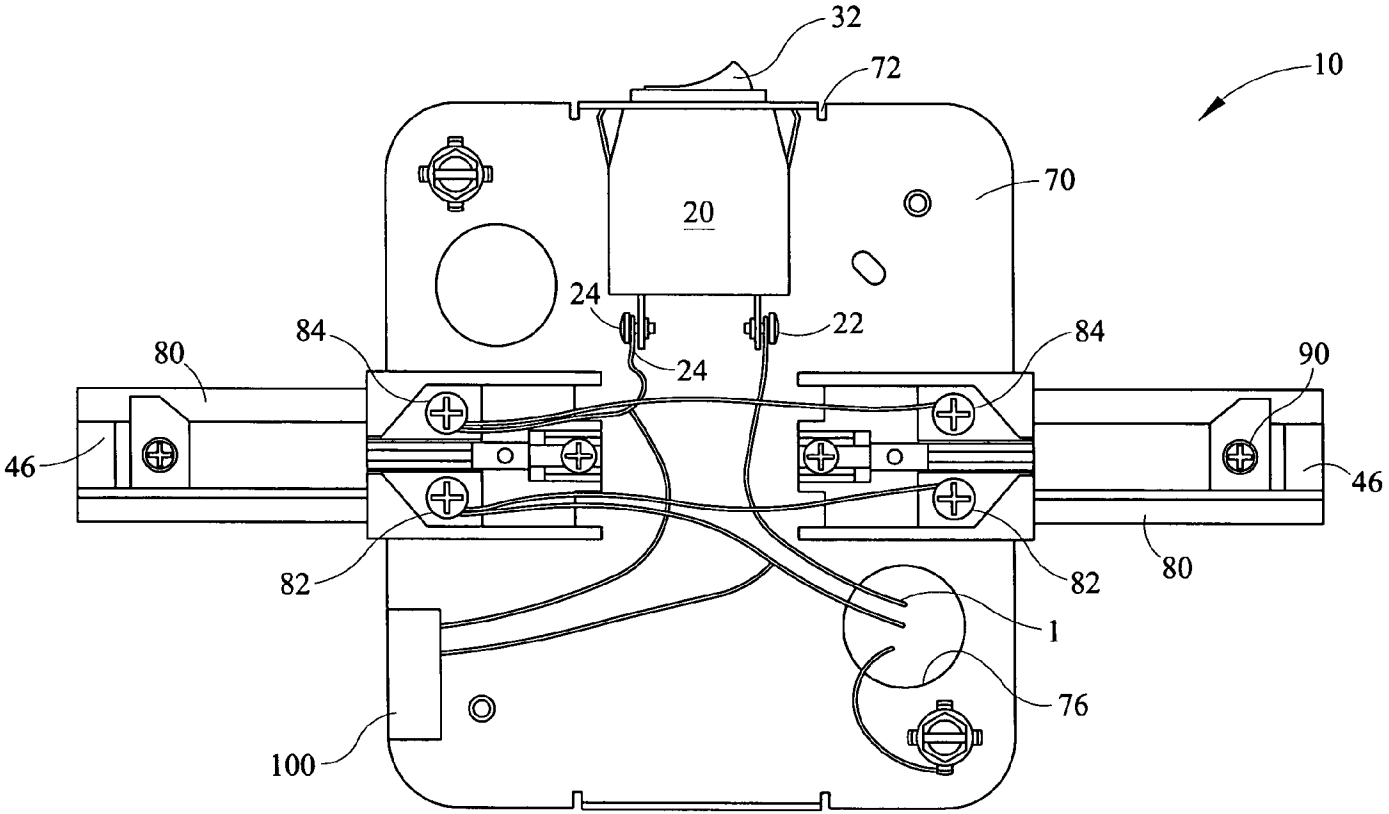
FIG. 2 is a plan view of the system of the present invention in accordance with one embodiment thereof.
Figure 4:
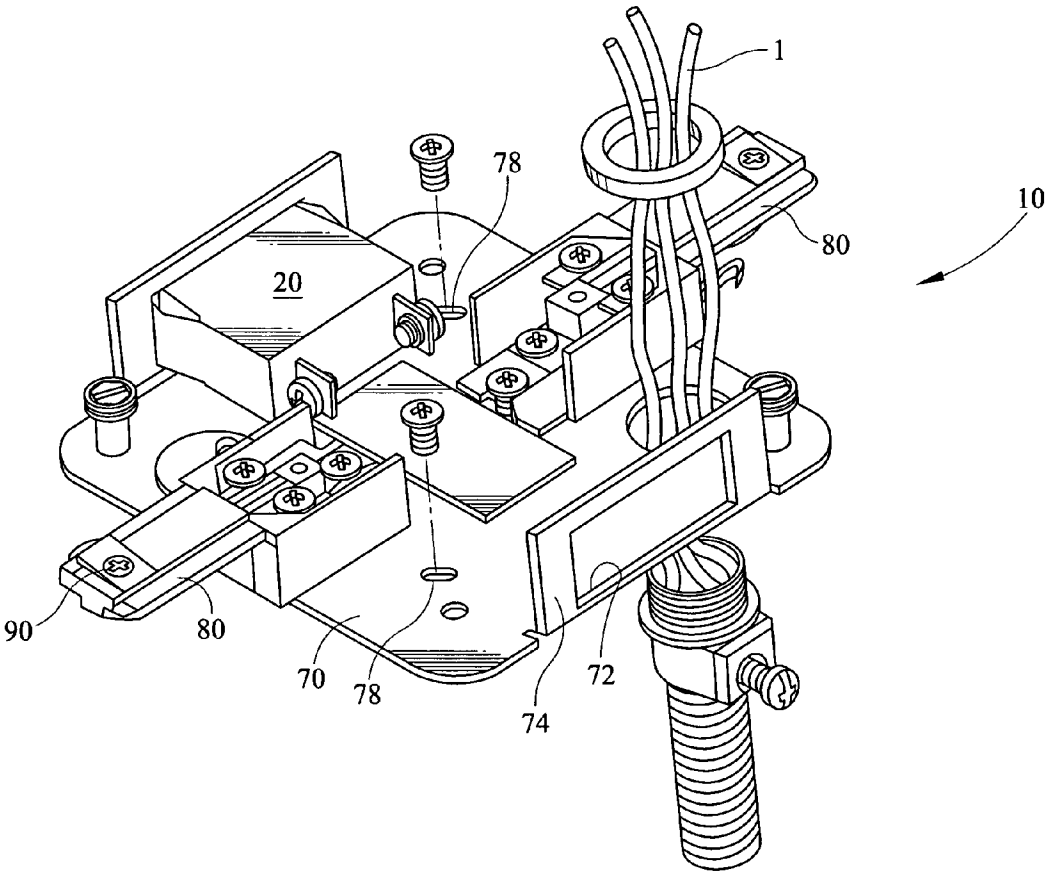
FIG. 4 is an exploded view of the system of the present invention in accordance with one embodiment thereof.

As best seen in FIGS. 2 and 4, the canopy 70 may include a plurality of knockouts 76 that may be removed in order to secure a conventional electrical conduit to the canopy 70, and through which the power source 1 wiring may be routed. The canopy may also include a plurality of mounting holes 78 therein, that are sized to accept fasteners in order to secure the canopy to a junction box or other surface. In one embodiment of the present invention, the canopy 70 is sized such that it covers a junction box (not shown) into which power wiring is routed, as is known to one of ordinary skill in the art.

The canopy 70 also includes at least one track connector 80 designed to be secured to the track rail 46. The track connector 80 may have a pair of fasteners such as screws 82 and 84 respectively, that accept a hot wire supplied as the output 24 from the current limiting device 20, and a neutral wire from the power source 1. The screws 82 and 84 are electrically connected to the track conductors 42 and 44 respectively, thus supplying electrical power to the track lighting system 40. The canopy 70 may incorporate a plurality of track connectors 80 in order to supply a plurality of lighting tracks 46 with electrical power. A wide variety of known track connectors may be employed with the system 10 of the present invention, including "L", "X", "T", and variable angle connectors.

The track connectors 80 may include an aperture 86 that is designed to accept a fastener 90 to secure track 46 to track connector 80. In one embodiment of the present invention, a one-way screw may be used as fastener 90 such that, once installed, the track 46 and track connector 80 can not be separated without resorting to special tools. Accordingly, this feature of the invention make the system 10 tamper-proof, since it is difficult to disassemble once the one-way screw(s) are inserted. In a yet further embodiment of the present invention, a tamper-proof seal such as an adhesive label or seal may be placed over a conventional fastener 90 in order to both warn of the potential for electrical shock and inhibit unauthorized personnel from altering or disassembling the system 10.

Figure 5:
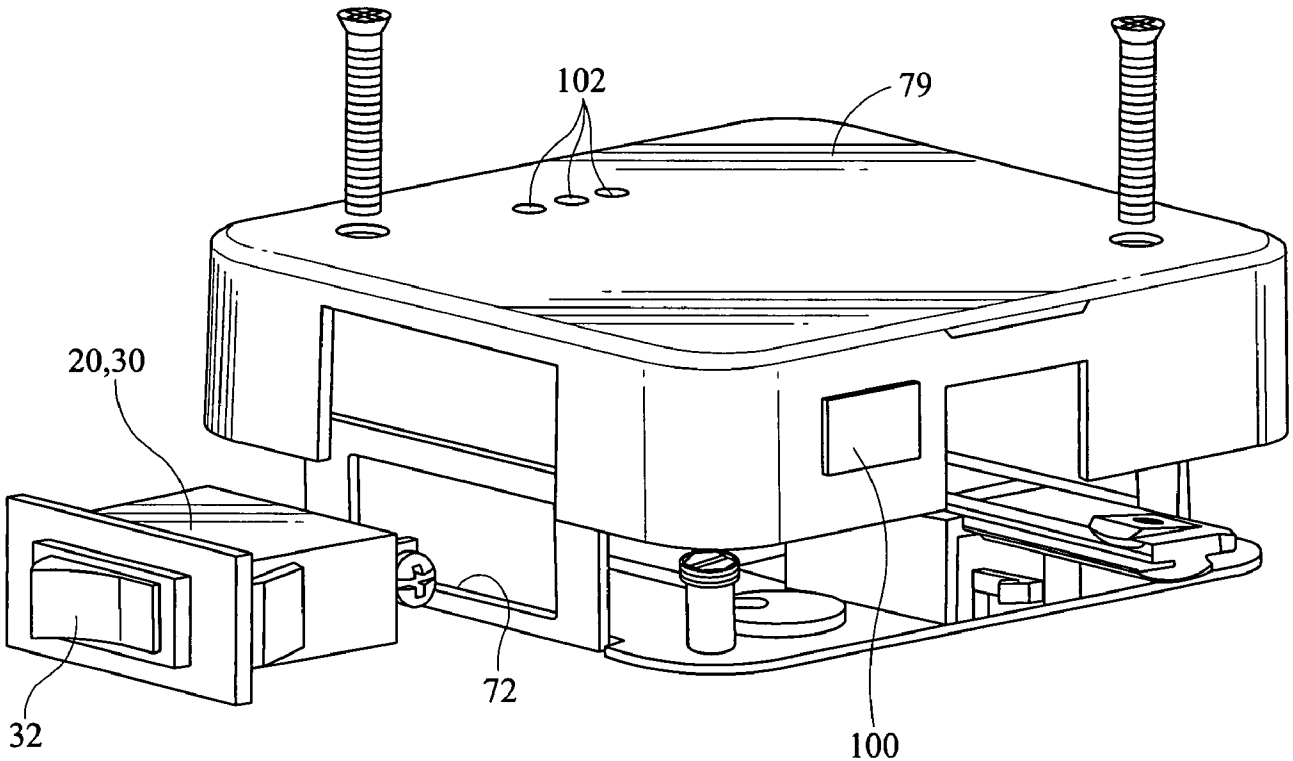
FIG. 5 is an isometric view of the system of the present invention in accordance with one embodiment thereof.

As best seen in FIG. 5, a cover 79 may be provided that is shaped to mate with the canopy 70 and is secured thereto by conventional fasteners. The circuit breaker 30 switch 32 remains accessible to enable the breaker 30 to be reset. Furthermore, the breaker switch 32 may be a lighted switch or include a non-illuminated visual indicator (such as a color) to enable a user to determine whether the breaker 30 itself has tripped, or whether power is not present at the breaker. Furthermore, in an alternative embodiment of the present invention, the breaker switch 32 may include indicia that are visible after installation informing a user of the maximum electrical load permitted on the track circuit supplied by the breaker 30.

In a yet further embodiment of the present invention, the current limiting device 20 may include a visual electrical load indicator 100 to indicate power or current in a given track circuit. The load indicator 100 may comprise a conventional digital or analog meter, or simply a plurality of light emitting diodes 102 to indicate power or current load. Where diodes 102 are employed, various colors could, for example, be utilized to indicate operation within a predetermined load range. As one example, a green led may be energized when the current limiting device is within a normal range, a yellow led may be energized when the current limiting device is within a predetermined percentage of maximum load, and a red led may be energized when the current limiting device is overloaded or tripped. The visual indicator or LED's are preferably visible through an aperture or apertures in the cover 79. One of ordinary skill will appreciate that a wide variety of circuits may be employed to supply the load indicator 100 and/or diodes with a signal to indicate current or power usage through the current limiting device 20.

The foregoing detailed description of the embodiments of the present invention is presented primarily for clearness of understanding and no unnecessary limitations are to be understood or implied therefrom. Modifications to the present invention in its various embodiments will become obvious to those skilled in the art upon reading this disclosure and may be made without departing from scope of the invention encompassed by the claims appended hereto.

We claim:

1. A current limiting system for limiting the electrical current supplied by a source of electrical power to a track lighting system comprising:

a lighting track having an integral circuit;

at least one current limiting device electrically coupled between said electrical power source and said circuit for supplying power thereto, said current limiting device having a current rating below that of said lighting track circuit; and wherein said lighting track is permanently secured to said current limiting device for limiting the electrical current in said track.

2. A current limiting system as claimed in claim 1 wherein said at least one current limiting device comprises a circuit breaker.

3. A current limiting system as claimed in claim 2 wherein said circuit breaker further comprises a switch for connecting and disconnecting electrical power from said circuit.

4. A current limiting system as claimed in claim 3 wherein the switch of said circuit breaker includes a visual indication of power to said breaker.

5. A current limiting system as claimed in claim 1 further comprising:

a canopy having a plurality of apertures therein for retaining said at least one current limiting device.

6. A current limiting system as claimed in claim 5 wherein said canopy further comprises a plurality of lighting track connectors and wherein said at least one current limiting device is electrically connected to said lighting track connectors to supply electrical power thereto.

7. A current limiting system as claimed in claim 5 wherein said canopy further comprises a removable knockout for routing power wiring therethough to said at least one current limiting device.

8. A current limiting system as claimed in claim 7 further comprising a plurality of removable knockouts in said canopy.

9. A current limiting system as claimed in claim 5 wherein said canopy is sized to cover a junction box.

10. A current limiting system as claimed in claim 5 further comprising:

a removable cover secured to said canopy to protect said system.

11. A current limiting system as claimed in claim 10 wherein said at least one current limiting device comprises a circuit breaker having a switch for connecting and disconnecting electrical power from said circuit, and wherein said removable cover provides access to the switch.

12. A current limiting system as claimed in claim 6 wherein said plurality of lighting track connectors are permanently secured to said lighting track to prevent the removal of said lighting track from said system once installed.

13. A current limiting system as claimed in claim 6 wherein said plurality of lighting track connectors are permanently secured to said lighting track with a one-way fastener to prevent the removal of said lighting track from said system once installed.

14. A current limiting system as claimed in claim 6 wherein said plurality of lighting track connectors are permanently secured to said lighting track with a fastener covered by a safety seal to inhibit the removal of said canopy from said system once installed.

15. A current limiting system as claimed in claim 1 wherein said current limiting device is sized to limit electrical current to a predetermined maximum based upon the length of track secured thereto.

16. A current limiting system for limiting the electrical current supplied by a source of electrical power to a track lighting circuit comprising:

at least one current limiting device having an input connected to an electrical power source and an output for supplying power, said current limiting device being inseparable from at least one lighting track and having a current rating below that of said lighting track;

a plurality of lighting track connectors wherein the output of said at least one current limiting device is electrically connected to said plurality of lighting track connectors to supply electrical power thereto; and wherein said current limiting system is permanently secured to said track lighting circuit for limiting the electrical current in said track.

17. A current limiting system for limiting the electrical current supplied by a source of electrical power to a plurality of track lighting circuits comprising:

a plurality of current limiting devices having respective inputs connected to an electrical power source and respective outputs for supplying power, said plurality of current limiting devices each being inseparable from at least one lighting track and having current ratings below that of said track lighting circuits;

a plurality of lighting track connectors wherein the outputs said plurality of current limiting devices are electrically connected to said plurality of lighting track connectors to supply electrical power thereto; and wherein said current limiting system is permanently secured to said track lighting circuits for limiting the electrical current in said track circuits.

18. A current limiting system as claimed in claim 1 wherein said current limiting device comprises a visual load indicator for monitoring the electrical power supplied to said circuit.

19. A current limiting system as claimed in claim 18 wherein said visual load indicator is a digital display.

20. A current limiting system as claimed in claim 18 wherein said visual load indicator is an analog display.

21. A current limiting system as claimed in claim 18 wherein said visual load indicator comprises a plurality of light emitting diodes indicative of predetermined amounts of power supplied to said circuit.

22. A current limiting system as claimed in claim 10 wherein said current limiting device comprises a visual load indicator for monitoring the electrical power supplied to said circuit.

23. A current limiting system as claimed in claim 22 wherein said visual load indicator is a digital display.

24. A current limiting system as claimed in claim 22 wherein said visual load indicator is an analog display.

25. A current limiting system as claimed in claim 22 wherein said visual load indicator comprises a plurality of light emitting diodes indicative of predetermined amounts of power supplied to said circuit.

26. An integral device for limiting electrical power supplied to track lighting comprising:

a power limiting device coupled to a source of electrical power;

a track lighting system electrically coupled to said power limiting device for limiting the electrical current in said track lighting system; and wherein said power limiting device is integral to said track lighting system to prevent removal thereof and wherein said power limiting device has a power rating below that of said lighting track system.

27. The integral device for limiting electrical power supplied to track lighting as claimed in claim 26 comprising:

at least one tamper proof mechanism to prevent access to said power limiting device.

28. The integral device for limiting electrical power supplied to track lighting as claimed in claim 26 comprising:

a load readout coupled to said power limiting device to monitor the electrical power supplied from said source.

29. The integral device for limiting electrical power supplied to track lighting as claimed in claim 26 comprising:

a circuit breaker having a reset switch integral to said power limiting device.

30. The integral device for limiting electrical power supplied to track lighting as claimed in claim 26 comprising:

an access panel to permit access to a fuse.

31. The integral device for limiting electrical power supplied to track lighting as claimed in claim 28 wherein said load readout comprises a meter.

32. The integral device for limiting electrical power supplied to track lighting as claimed in claim 28 wherein said load readout comprises a plurality of LEDs.

33. The integral device for limiting electrical power supplied to track lighting as claimed in claim 28 wherein said load readout comprises an analog gauge.

34. The integral device for limiting electrical power supplied to track lighting as claimed in claim 32 comprising:

a first LED indicative of operation within a rated load of said track lighting;

a second LED indicative of operation near a maximum rated load of said track lighting; and a third LED indicative of an overload condition of said track lighting.

* * * * *